US007815583B2

(12) United States Patent
Harris et al.

(10) Patent No.: US 7,815,583 B2
(45) Date of Patent: Oct. 19, 2010

(54) BODY PART TREATMENT DEVICE WITH AIR DIVERTER

(75) Inventors: David Harris, Hollis, NH (US); Stephen B. Mills, Atkinson, NH (US); Charles J. Burout, Bedford, NH (US)

(73) Assignee: Brookstone Purchasing, Inc., Merrimack, NH (US)

( * ) Notice: Subject to any disclaimer, the term of this patent is extended or adjusted under 35 U.S.C. 154(b) by 1190 days.

(21) Appl. No.: 11/435,282

(22) Filed: May 17, 2006

(65) Prior Publication Data

US 2007/0267020 A1 Nov. 22, 2007

(51) Int. Cl.
*A61H 1/00* (2006.01)

(52) U.S. Cl. ..... 601/16; 601/15; 601/22

(58) Field of Classification Search ..... 601/15, 601/16, 22, 27, 28, 29, 30, 31, 64, 104, 107, 601/108; 34/90, 97, 232–235, 379
See application file for complete search history.

(56) References Cited

U.S. PATENT DOCUMENTS

| | | | | |
|---|---|---|---|---|
| 4,513,735 | A | | 4/1985 | Friedson et al. |
| 5,167,225 | A | | 12/1992 | Cheng-I |
| 5,501,682 | A | | 3/1996 | Edwards-Cofie |
| 5,573,500 | A | | 11/1996 | Katsunuma et al. |
| 5,613,304 | A | * | 3/1997 | Lin ..... 34/90 |
| 5,681,266 | A | | 10/1997 | Lin |
| 5,772,615 | A | | 6/1998 | Elder et al. |
| 5,785,668 | A | | 7/1998 | Shimizu |
| 5,827,205 | A | | 10/1998 | Iwamoto |
| 5,868,688 | A | | 2/1999 | Avidor et al. |
| D420,450 | S | | 2/2000 | Anthony et al. |
| 6,451,266 | B1 | | 9/2002 | Lau et al. |
| 6,494,849 | B2 | | 12/2002 | Kuo |
| 6,602,212 | B1 | | 8/2003 | Ahn |
| 2005/0256432 | A1 | | 11/2005 | Harris et al. |
| 2006/0027551 | A1 | | 2/2006 | Dehli |

OTHER PUBLICATIONS

Interactive Health, Equalizer FootPro EQ-400, Product Information page on www.interhealth.com, Nov. 25, 2004.
Interactive Health, Warm Air Technology WA-200, Product Information page on www.interhealth.com, Nov. 25, 2004.
Interactive Health, Warm Air Technology WA-200, Use and Care Manual, 2001.

* cited by examiner

*Primary Examiner*—Quang D Thanh
(74) *Attorney, Agent, or Firm*—Grossman Tucker Perreault & Pfleger

(57) ABSTRACT

A device for applying treatment, or therapy, to a body part directs air efficiently and effectively to the body part by using an air diverter. In particular, a device for treating a body part, such as a massager, has one or more treatment areas positioned to deliver treatment to the body part and an air blower having an air outlet that creates a flow of air in an outward direction from the air outlet. The air diverter is positioned to divert the flow of air to the one or more treatment areas.

37 Claims, 3 Drawing Sheets

SECTION AA-AA
SCALE 0.5

BODY PART TREATMENT DEVICE WITH AIR DIVERTER

BACKGROUND OF THE INVENTION

1. Field of the Invention

The present invention relates generally to devices for applying treatment, or therapy, to a body part, and more particularly, to a device that treats a body part by directing air to the body part with an air diverter.

2. Description of the Related Art

Massage treatment or therapy involves the rubbing and kneading of the body's soft tissues, such as the skin and muscles. Massage may be helpful in reducing tension and pain, improving blood flow, and encouraging relaxation. In particular, massage stimulates blood circulation to improve the supply of oxygen and nutrients to body tissues, thereby easing tense and knotted muscles as well as stiff joints. To improve the beneficial effects created by massaging a soft tissue, some form of heating or cooling treatment may also be applied to the tissue area.

Devices are available for self-application of massage therapy to an individual's own body. In order to create the rubbing and kneading necessary for massaging a body part, these massaging devices generally have treatment areas that contact the body part and apply percussive, oscillating, vibrating, rotating, or other mechanical motion to the body part. Often, massaging devices provide some way to heat or cool the body part to improve the massage therapy. In particular, heating or cooling of the massaged body part by directing air of a certain temperature to the treatment area of the massaging device, which contacts the body part.

For example, one type of massaging device is a foot massager. The foot massager can sit on the floor where an individual can conveniently place his or her feet on one or more treatment areas, which deliver massaging therapy to the feet. The foot massager may also have an air blower within the housing of the foot massager which takes in outside air, heats or cools the air, and blows the heated or cooled air within the housing. The air is intended to provide additional therapy through the treatment areas to the individual's feet.

SUMMARY OF THE INVENTION

It has been discovered that massaging devices, such as the foot massager described previously, often do not effectively or efficiently deliver air from the air blower to the treatment area. Accordingly, the present invention provides a treatment device with an air diverter that promotes effective and efficient delivery of air from the air blower to the treatment areas of the treatment device.

In one embodiment of the present invention, a device for treating a body part has a treatment area positioned to deliver treatment to the body part, an air blower having an air outlet that creates a flow of air in an outward direction from the air outlet, and an air diverter positioned to divert the flow of air to the treatment area. The air diverter has two walls, each wall having a surface facing the flow of air, a near end, and a far end positioned farther from the air outlet in the outward direction than the near end. The near ends of the two walls are adjacent to one another, and the far ends of the two walls are separated by a far width. In particular, each of the two walls of the air diverter may have an arcuate section and a planar section. The arcuate section begins at the near end and extends to an intermediate part of the surface, and the planar section begins at the intermediate part and extends to the far end. The arcuate sections of the two walls have approximately equal radii of curvature which are measured from a point positioned at the air outlet. In this particular embodiment, the near ends of the two walls engage each other at a point at the air outlet, on a plane that substantially bisects the air outlet. Moreover, each surface of the two walls have a section with a height that is approximately equal to the height of the air outlet. Additionally, the width between the far ends of the two walls is greater than the width of the air outlet.

In another embodiment of the present invention, a device for treating body parts has a first treatment area and a second treatment area positioned to deliver treatment to the body parts, an air blower having an air outlet which creates a flow of air in an outward direction from the air outlet, and an air diverter adapted to separate the flow of air into a first flow path directed to the first treatment area and a second flow path directed to the second treatment area.

In yet another embodiment, a device for treating body parts has treatment areas positioned to deliver treatment to the body parts, an air blower, an air diverter, and a housing including a first section and a second section with the air blower positioned in the first section and with the treatment areas and the diverter positioned in the second section, where the air blower creates a flow of air in an outward direction from the first section of the housing to the second section of the housing, and the air diverter directs the flow of air from the air blower to the treatment areas.

In the embodiments above, the air from the air blower may be heated, cooled, or remain at ambient temperature. Moreover, the treatment areas may provide massaging treatment to the body parts.

DETAILED DESCRIPTION

It has been discovered that treatment devices, such as massaging devices, that also therapeutically apply air from an air blower do not effectively or efficiently deliver the air to the treatment areas. In many cases, the size, shape, positioning, and orientation of the air blower within the massager housing is affected by other components of the massaging device or by the desire to have a compact or aesthetically pleasing housing design. Thus, delivery of heated air to the treatment areas is far less than optimal. Accordingly, the present invention provides a treatment device with an air diverter that promotes effective and efficient delivery of air from an air blower to the treatment areas of the treatment device, regardless of the size, shape, positioning, or orientation of the air blower in the treatment device.

Figure 1:
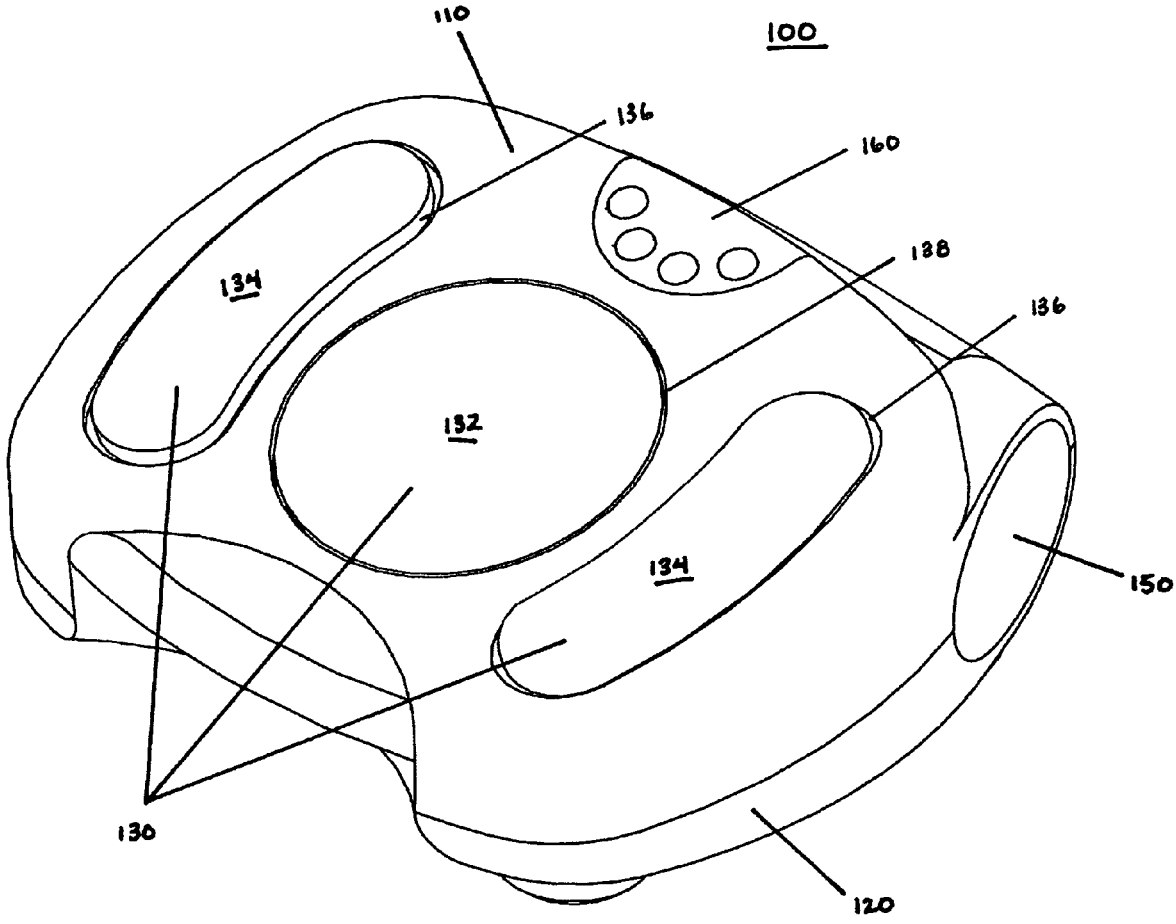
FIG. 1 illustrates an external view of an exemplary embodiment of the present invention.

As illustrated in FIG. 1, an exemplary embodiment of the present invention is a foot massaging device 100 with a first, or upper, housing 110 and a second, or lower, housing 120. The outer surface of the upper housing 110 has more than one treatment areas 130, which contact a user's feet and apply massaging treatment. The massaging device 100 receives power from a power supply (not shown), such as an electrical outlet or a battery. Using the power supply, the massaging device 100 may create massaging treatment by activating one or more assemblies (not shown) to deliver percussive, oscillating, vibrating, rotating, or other motion to the treatment areas 130. These massaging assemblies may include electrical motors which cause motion of intermediate parts coupled to the treatment areas 130. Furthermore, the activation of these massaging assemblies can be controlled by a control device 160, which may be a simple control panel with activation switches or a receiver to accept signals from a remote control operated by the user.

In the embodiment shown in FIG. 1, Shiatsu treatment area 132 delivers Shiatsu-type massaging treatment to a user's feet, while the foot pedals 134 deliver percussive massaging treatment. The foot pedals 134 are each positioned on opposing sides of the surface of the upper housing 110, with the Shiatsu treatment area 132 positioned in the area separating, or intermediate, the foot pedals 134.

In addition to applying mechanical massaging treatment, the massaging device 100 also delivers treatment to the user's feet by directing air to the treatment areas 130. In particular, the air is heated and delivered to the foot pedals 134. In the illustrated embodiment, the heated air is delivered to the user's feet when it flows from the foot pedals 134 through thin openings, or gaps, 136 that outline the foot pedals 134. Similarly, heated air can also be delivered to the user's feet at the Shiatsu treatment area 132 through thin openings, or gaps, 138 that outline the area 132.

Although the present invention is described in terms of the foot massaging device 100, the foot massaging device 100 is only an exemplary embodiment and is presented only to facilitate understanding of the inventive features of the present invention. The foot massaging device 100 delivers treatment to a user's feet, but it is understood that the present invention is intended to deliver treatment to any body part or any combination of body parts. In addition, the present invention may deliver a variety of treatments to these body parts. The present invention is not limited to the application of Shiatsu-type or percussive massaging treatments, with the delivery of heated air. Embodiments of the present invention can employ any method of manipulating body tissues or muscles. Indeed, the present invention does not have to apply any massaging treatment. For instance, an embodiment could simply direct air toward the body part without any massaging treatment. Moreover, the air can have any temperature. In other words, the air may be heated or cooled by a temperature changing element, or may even remain at ambient temperature.

Figure 2:
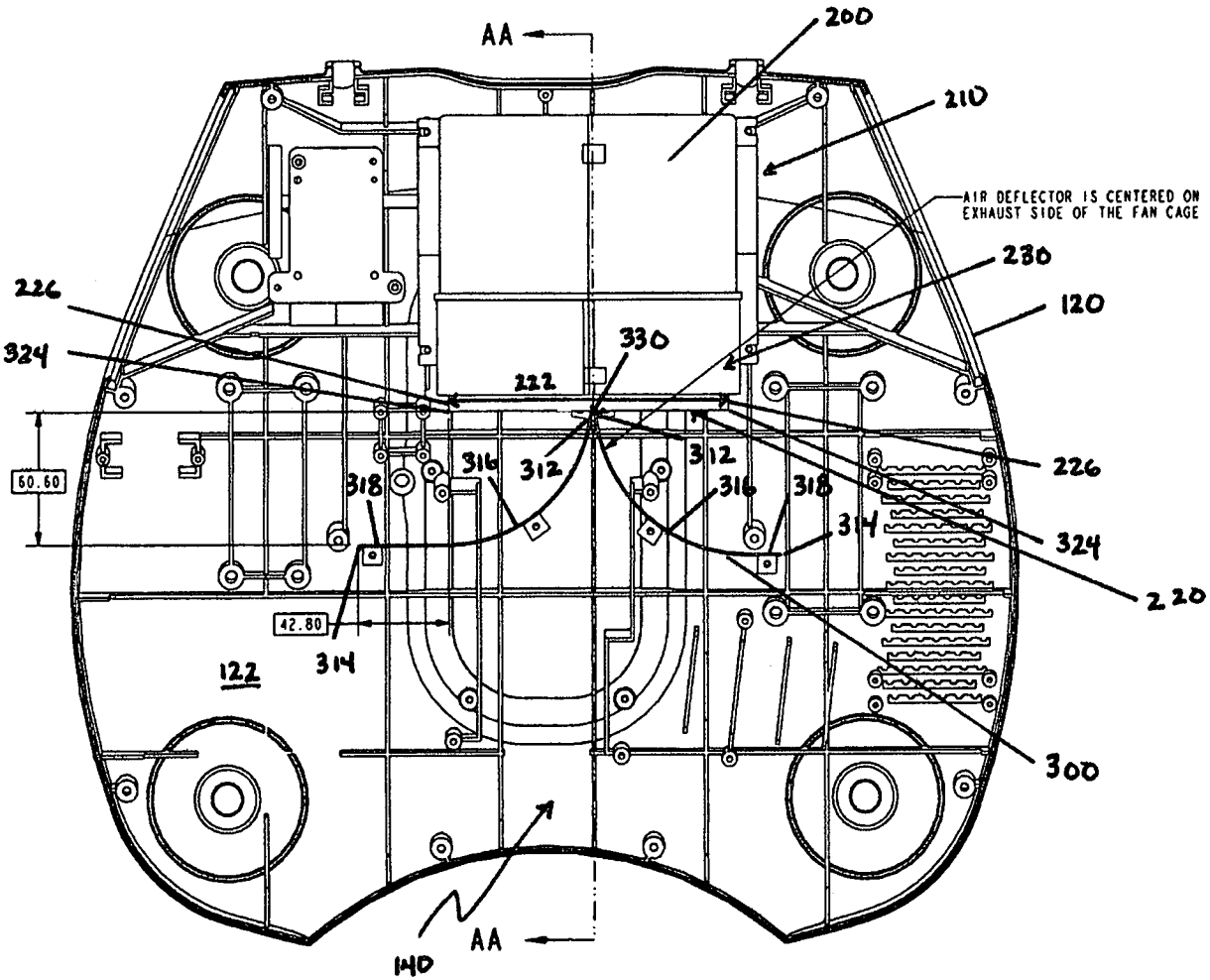
FIG. 2 illustrates an internal top view of the exemplary embodiment of FIG. 1.

Thus, using the foot massaging device 100 as an example, the upper housing 110 and the lower housing 120 form an interior cavity 140, shown in FIG. 2. The interior cavity 140 accommodates a plurality of devices and assemblies that generate and deliver the mechanical massaging treatment and heated air to the treatment areas 130.

Considering the generation and delivery of the heated air, specifically, the foot massaging device 100 has vents 150, shown in FIG. 1, which permit air to enter the interior cavity 140. As illustrated in FIG. 2, the device 100 has a air blower fan assembly 200 with an air inlet opening 210 and an air outlet 220. The outlet 220 in this exemplary embodiment is substantially rectangular, but the shape of the outlet 220 is not limited to this particular shape. The blower fan assembly 200 is situated on the lower surface 122 of the lower housing 120, but may engage any surface with the interior cavity 140. A scroll fan 250, shown in FIG. 3, draws air transversely through the inlet opening 210 and forces the air out through the outlet 220. It is understood, however, that the fan assembly 200 is not limited to the use of the scroll fan 250, but may employ different types of fan blades or other mechanisms, known to those of ordinary skill in the art, which are capable of creating air flow.

The fan assembly 200 has heating elements 230 which generate heat when electricity, or other power source, is applied to the elements 230. The air flow created by the scroll fan 250 is heated as it moves around the heating elements 230 inside the fan assembly 200. Thus, heated air flows through the outlet 220 into the cavity 140. The delivery of heated air to the treatment areas 130 can also be controlled by the control device 160, which activates the fan assembly 200 and the heating elements 230.

As FIG. 2 shows, the fan assembly 200 is centrally positioned at a first section, or end, of the interior cavity 140. Due to the orientation of the outlet 220, the air flowing from the outlet 220 is directed in one direction toward a second section, or end, of the cavity 140, where the treatment areas 130 are positioned. In addition, the flow of the air is directed generally parallel to the bottom surface 122 of the lower housing 120. It has been discovered that air directed in this way fails to create air flow in the cavity 140 that is effectively directed to the treatment areas 130 located on the upper housing 110. Air flow to the treatment areas, such as the foot pedals 134, can be particularly ineffective. As described previously, the foot pedals 134, as shown in FIG. 1, are each positioned on opposing sides of the surface of the upper housing 110. As a result, the flow of air from the outlet 220 is directed to an area in the cavity 140 between and below the foot pedals 134.

Accordingly, as further illustrated in FIG. 2, the present invention employs an air diverter 300, which creates upward airflow toward the treatment areas 130, particularly the foot pedals 134, located on the upper housing 110. The air diverter 300 may be situated on the lower surface 122 of the lower housing 120 and held in place by any fastening mechanism. For instance, the bottom of the diverter 300 may have flanges or brackets that allow the diverter to be screwed to the lower surface 122. Thus, in the illustrated embodiment, the air diverter 300 and the outlet 220 are positioned along one plane while the treatment areas 130 are positioned on a second plane spaced above the first plane. Moreover, the fan assembly 200 is positioned at a first section of the interior cavity 140, while the air flowing from the outlet 220 is directed in one direction toward a second section of the cavity 140, where the diverter 300 is positioned with the treatment areas 130.

Figure 3:
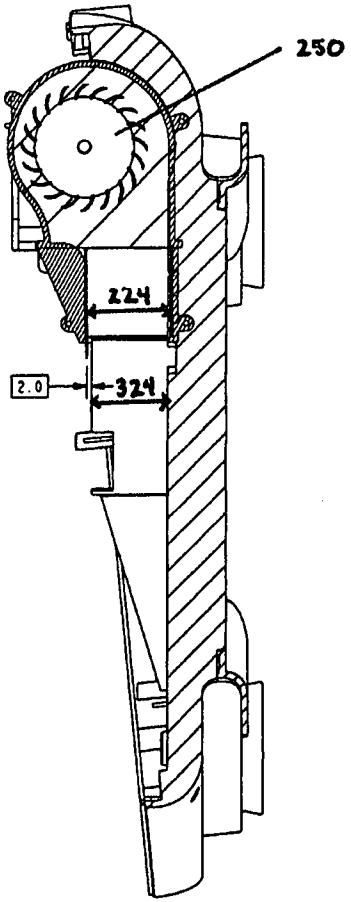
FIG. 3 illustrates an internal side view of the exemplary embodiment of FIG. 1.
Figure 4:
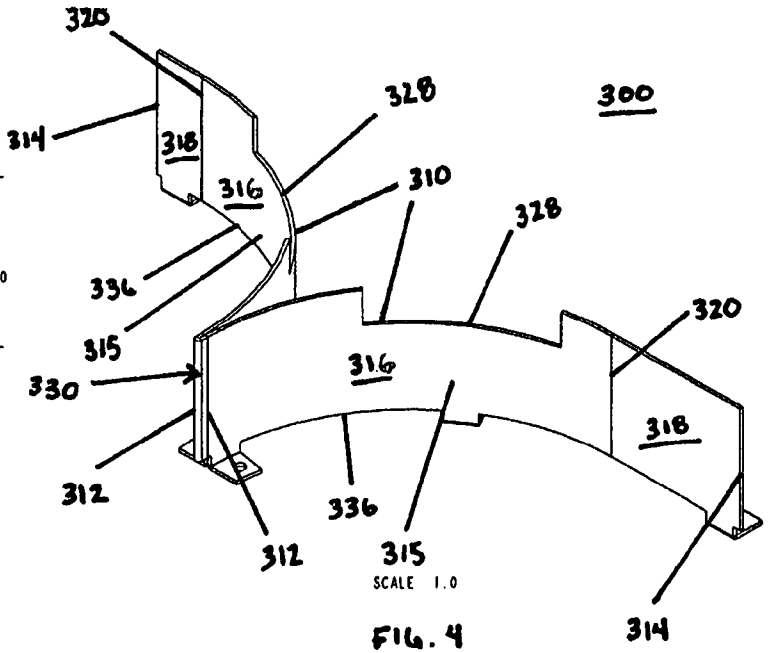
FIG. 4 illustrates a perspective view of the air diverter used by the exemplary embodiment of FIG. 1.

As shown in FIGS. 2 and 4, the air diverter 300 has two walls 310. Each wall 310 has a surface 315 that faces the outlet 220 and is positioned in the flow leaving the outlet 220. Thus, the air from the outlet 220 flows into the surfaces 315 of the two walls 310, causing the air to change direction. To effectively change the direction of the air, portions of the surface 315 of each wall have a height 304 that is substantially equal to the height 224 of the outlet 220, as shown in FIG. 3. In general, the shape, dimension, and positioning of the walls 310 maximize the upward flow of air toward the treatment areas 130 on the upper housing 110.

As illustrated in FIG. 4, each wall 310 has a near end 312 and a far end 314. FIG. 2 shows that the near end 312 of each wall 310 is positioned closer to the outlet 220 than the far end 314. The near ends 312 of the two walls 310 are adjacent to each other. In the illustrated embodiment, the near ends 312 engage each other at a point 330 positioned at, or substantially proximate to, the outlet 220. Preferably, the point 330 lies on a plane that bisects the outlet 220, thus causing the air flowing from outlet 220 to be divided substantially evenly between the two walls 310.

Figure 5:
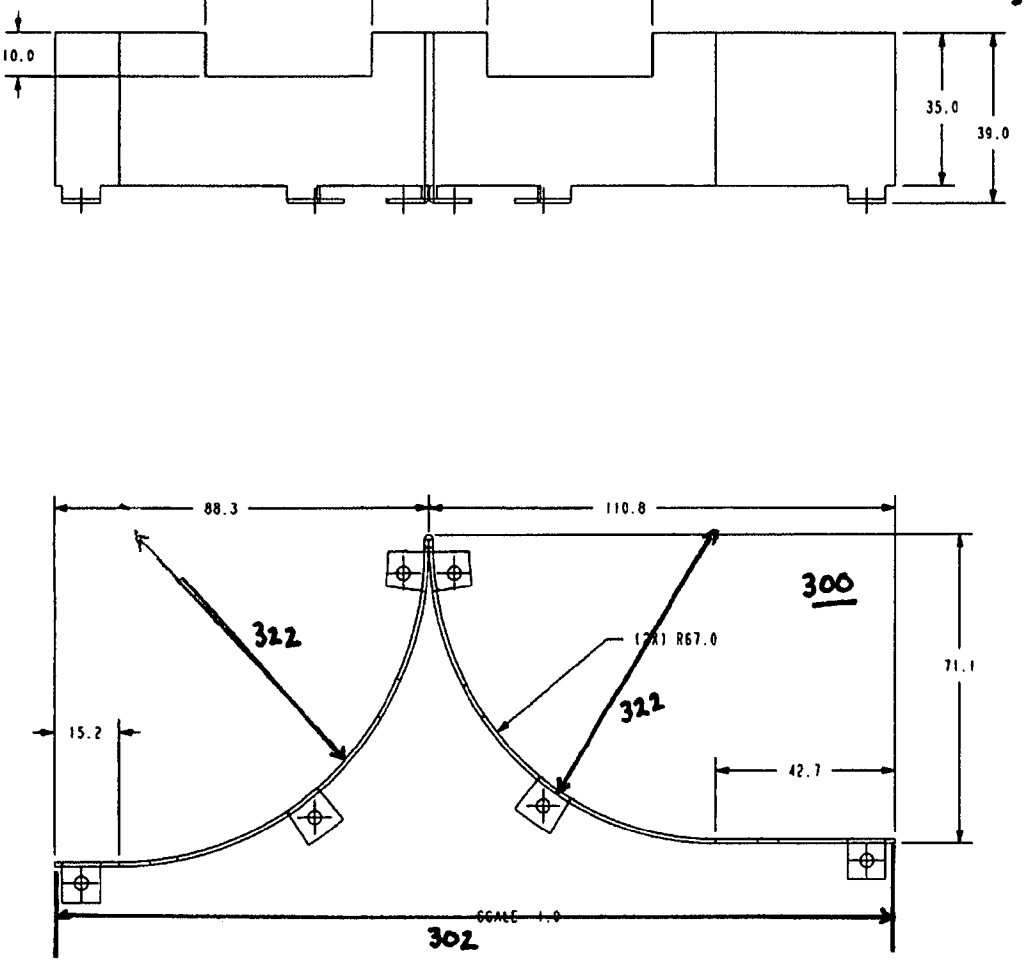
FIG. 5 illustrates a bottom view of the air diverter used by the exemplary embodiment of FIG. 1.

The far ends 314 are separated by a diverter width 302, shown in FIG. 5. Thus, the two walls 310 engage one another at the point 330 and extend away from each other to their far ends 314. To effectively change the direction of the air, the diverter width 302 is greater than the width 222 of the outlet 220, as shown in FIG. 2.

In particular, the far ends 314 are positioned proximate to the foot pedals 134 to promote the flow of air to the foot pedals 134. In other words, the air diverter 300 is adapted to separate the flow of air into a first flow path directed to the one of the foot pedals 134 and a second flow path directed to the other foot pedal 134. In general, however, the air diverter 300 of the present invention can be employed to promote effective air flow to any treatment area 130, such as the Shiatsu treatment area 132. Any description of the air diverter 300 specifically discussing its use with respect to the foot pedals 134 is presented only in order to provide a better understanding of the features of the present invention.

As further illustrated in FIGS. 2, 4, and 5, the surface 315 of each of the walls 310 has an arcuate section 316 and a planar section 318. The arcuate section extends from the near end 312 and to an intermediate part 320 of the surface 315, forming a curve bowing away from the other wall. The arcuate sections of the walls 310 in this exemplary embodiment have substantially equal radii of curvature 322. The ratio of the radius of curvature 322 to the width 222 of the outlet 220 preferably falls in the range of 0.45 to 0.55. With this ratio, the radius of curvature 322 of each wall is measured from a point 324 that is proximate to one side 226 of the outlet 220.

As described previously, the planar section 318 of each wall extends from the intermediate part 320 to the far end 314. Because the far ends 314 are proximate to the foot pedals 134, the planar sections 318 extend to the foot pedals 134, directing the flow of air to the foot pedals 134. To promote similar flow of air to both sides of the cavity 140 and to the foot pedals 134, the intermediate parts 320 of the walls 310 are positioned at the same distance from the outlet 220. Moreover, the intermediate parts 320, the far ends 314, and the planar sections 318 of the walls lie on the same plane. This plane is substantially parallel to the outlet 220 and intersects the longitudinal axes of the foot pedals 134.

Although the shape and dimensions of the surface 315 described above may be preferred, the shape and dimensions are not limited to those of the exemplary embodiment illustrated in FIGS. 2, 4, and 5. The surface 315, however, should be shaped so that the transition from the near end 312 to the far end 314 is gradual, thus minimizing the amount of turbulence in the air flow. In addition, the surface 315 should extend to far ends 314 to promote air flow to desired treatment areas 130.

While the air diverter 300 diverts or redirects the air flowing from outlet 320 toward the upper housing 110, it may be desirable to have air flow past the air diverter 300 to promote mixing of air throughout the cavity 140 or to allow heated air to also reach parts of treatment areas 130 that may be positioned past the air diverter 300. Therefore, the walls 310 of air diverter 300, as illustrated in FIG. 4, preferably have portions with a lower edge 336 that are spaced away from the lower surface 122 of the lower housing 120 when the air diverter 300 is positioned on the lower surface 122. The clearance between the lower edge 336 and the lower surface 122 allows air to flow below the air diverter 300.

The cavity 140 of the foot massaging device 100 also houses other devices, such as a percussion assembly to deliver percussive motion to the foot pedals 134 or a motor to deliver the Shiatsu-type massaging treatment to Shiatsu treatment area 132. The cavity. 140 may also have supporting structures for these mechanisms. The limited space within cavity 140 may place other mechanisms or structures in proximity to the air diverter 300. Thus, in order to promote the flow of air past the air diverter 300, the air diverter must also be spaced from these proximate mechanisms or structures. In addition, the walls 310 of the air diverter 300 may have to be shaped to allow positioning of these proximate mechanisms or structures within the cavity 140. For instance, FIG. 4 shows walls 310 with rectangular cutouts 328 to accommodate other mechanisms in the cavity 140.

The walls 310 of the exemplary embodiment as illustrated in FIG. 2 are thin to facilitate manufacturing and to minimize the overall size of the diverter 300 and impact on the arrangement of devices in the cavity 140. However, the thickness of the walls 310 are not limited to any particular thickness.

In addition, while the diverter 300 has the two walls 310, the diverter 300 may be manufactured from a single piece of material, so that the walls 310 are integral with one another and are connected at the point 330. On the other hand, the diverter 300 may be manufactured from more than one piece of material. In particular, the diverter 300 may be manufactured from two separate pieces, where each piece makes up one of the two walls 310. Moreover, while the embodiments described herein describe the use of two walls, multiple wall sections may be joined to provide a shape and configuration within the scope of the present invention.

As shown in FIG. 2, the two walls 310 engage each other at the point 330, but the two walls 310 do not have to be joined or even contact each other at their near ends 312. The near ends 312 should generally be adjacent to each other and spaced so that the flow of air from the outlet 220 is effectively divided.

Because the air diverter 300 directs air to desired areas of the cavity 140, the air diverter 300 allows the air blower 200 to be located in the cavity 140 away from the foot pedals 140. With the air diverter 300, the outlet 220 does not have to direct its flow of air to the foot pedals 140. Thus, the use of the air diverter 300 offers flexibility in the arrangement of the various devices within the cavity 140. The devices in the cavity 140 can be arranged compactly or according to a particular aesthetic design for the device 100.

It is understood that while exemplary embodiments of the present invention may described in terms of a massaging device, the present invention is not limited to a massaging device, but can also be any device that provides air treatment to a body part, as the embodiments described can clearly be implemented without any massaging treatment.

While the present invention has been described in connection with a number of exemplary embodiments, and implementations, the present inventions are not so limited, but rather cover various modifications, and equivalent arrangements, which fall within the purview of prospective claims.

What is claimed is:

1. A device for treating a body part, the device comprising:

a treatment area positioned to deliver treatment to the body part, the treatment area comprising a massaging device configured to mechanically massage the body part;

an air blower having an air outlet, the air blower creating a flow of air in an outward direction from the air outlet; and an air diverter positioned to divert the flow of air to the treatment area, wherein the air diverter comprises:

two walls, each wall comprising:

a surface facing the flow of air;

a near end; and a far end positioned farther from the air outlet in the outward direction than the near end, wherein the near ends of the two walls are adjacent to each other, and wherein the far ends of the two walls are separated by a far width.

2. The device according to claim 1, wherein the surface of at least one wall comprises an arcuate section forming a curve bowing away from the other wall.

3. The device according to claim 1, wherein each surface of the two walls has an arcuate section forming a curve bowing away from the air outlet, and the arcuate sections of the two walls have approximately equal radii of curvature.

4. The device according to claim 2, wherein the arcuate section of the at least one wall has a radius of curvature and the air outlet has an outlet width, and wherein a ratio of the radius of curvature to the outlet width is 0.45 to 0.55.

5. The device according to claim 2, wherein the arcuate section of the at least one wall has a radius of curvature measured from a point positioned at the air outlet.

6. The device according to claim 2, wherein the arcuate section of the at least one wall has a radius of curvature measured from a point positioned at approximately one side of the air outlet.

7. The device according to claim 2, wherein the arcuate section of the at least one wall has a radius of curvature measured from a point between the air outlet and the surface of the at least one wall.

8. The device according to claim 2, wherein the surface of the at least one wall further comprises a planar section.

9. The device according to claim 8, wherein the arcuate section of the surface of the at least one wall begins at the near end and extends to an intermediate part of the surface, and wherein the planar section begins at the intermediate part and extends to the far end.

10. The device according to claim 9, wherein the planar section is positioned on a plane perpendicular to the outward direction of the flow of air.

11. The device according to claim 1, wherein the far ends of the two walls are positioned on a plane perpendicular to the outward direction of the flow of air.

12. The device according to claim 1, wherein the air outlet has an outlet width and the far width between the far ends is greater than the outlet width.

13. The device according to claim 1, wherein the near ends of the walls engage each other on a plane that substantially bisects the air outlet.

14. The device according to claim 1, wherein the near ends of the walls engage each other at the air outlet.

15. The device according to claim 1, further comprising a lower housing and an upper housing, the lower section and the upper section together forming a cavity, wherein the air blower and the air diverter are positioned in the cavity.

16. The device according to claim 15, wherein a portion of at least one wall of the air diverter has a lower edge spaced away from a bottom surface of the lower housing to allow air to flow between the lower edge of the portion of the at least one wall and the bottom surface of the lower housing.

17. The device according to claim 15, further comprising lower housing structures, wherein the far ends of the walls are spaced away from the lower housing structures to allow air to flow between the far ends and the lower housing structures.

18. The device according to claim 1, wherein the treatment area comprises two foot pedals, and the air diverter diverts air to the two foot pedals.

19. The device according to claim 18, wherein the air diverter is positioned between the foot pedals.

20. The device according to claim 19, wherein the treatment area further comprises an intermediate surface positioned between the foot pedals and above the air diverter, and the air diverter diverts air to the intermediate surface.

21. The device according to claim 1, further comprising a temperature-changing element to heat or cool the flow of air.

22. The device according to claim 1, wherein the massaging device is configured to provide at least one of percussive, oscillating, vibrating, and rotating motion to said body part.

23. A device for treating at least one body part, the device comprising:

a first treatment area positioned to deliver treatment to at least one body part, and a second treatment area positioned to deliver treatment to at least one body part, at least one of the first and the second treatment areas comprising a massaging device configured to mechanically massage the at least one body part;

an air blower having an air outlet, the air blower creating a flow of air in an outward direction from the air outlet; and an air diverter adapted to separate the flow of air into a first flow path directed to the first treatment area and a second flow path directed to the second treatment area.

24. The device according to claim 23, wherein the air diverter comprises a first surface facing the flow of air to create the first flow path and a second surface facing the flow of air to create the second flow path.

25. The device according to claim 24, wherein the surfaces approximately divides the flow of air equally between the first flow path and the second flow path.

26. The device according to claim 24, wherein each surface has an arcuate section forming a curve bowing away from the air outlet.

27. The device according to claim 24, wherein each of the two surfaces further comprises a near end proximate to the air outlet and a far end positioned proximate to one of the two treatment areas.

28. The device according to claim 23, further comprising a first housing and a second housing, the first housing and the second housing together forming a cavity, wherein the air blower and the air diverter are positioned in the cavity, and wherein the treatment areas are positioned on at least on of the first and second housings.

29. The device according to claim 23, wherein the air diverter is positioned between the two treatment areas.

30. The device according to claim 23, further comprising a temperature-changing element to heat or cool the flow of air.

31. The device according to claim 23, wherein the massaging device is configured to provide at least one of percussive, oscillating, vibrating, and rotating motion to said body part.

32. A device for treating at least one body part, the device comprising:

at least one treatment area positioned to deliver treatment to at least one body part, the at least one treatment area comprising a massaging device configured to mechanically massage said at the one body part;

an air blower;

an air diverter; and a housing including a first section and a second section, the air blower positioned in the first section, and the at least one treatment area and the diverter positioned in the second section, wherein the air blower creates a flow of air in an outward direction from the first section of the housing to the second section of the housing, and the air diverter directs the flow of air from the air blower to the at least one treatment area.

33. The device according to claim 32, wherein the housing comprises a lower housing and an upper housing, wherein the air blower and the air diverter are positioned in the lower housing, and wherein the at least one treatment area is positioned on the upper housing.

34. The device according to claim 32, wherein the at least one treatment area comprises a first treatment area and a second treatment area, and wherein the air diverter is positioned between the first treatment area and the second treatment area.

35. The device according to claim 32, further comprising a temperature-changing element to heat or cool the flow of air.

36. The device according to claim 32, wherein the massaging device is configured to provide at least one of percussive, oscillating, vibrating, and rotating motion to said body part.

37. The device according to claim 32, wherein the air blower and the air diverter is positioned along a first plane and said treatment area is positioned along a second plane spaced from the first plane.

* * * * *